US008888442B2

(12) United States Patent
Bharath et al.

(10) Patent No.: US 8,888,442 B2
(45) Date of Patent: Nov. 18, 2014

(54) STRESS RELIEVING SLOTS FOR TURBINE VANE RING

(75) Inventors: Keppel Nyron Bharath, Cornwall (CA); John Pietrobon, Outremont (CA); Vincent Paradis, Montréal (CA); Douglas MacCaul, Varennes (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 362 days.

(21) Appl. No.: 13/361,095

(22) Filed: Jan. 30, 2012

(65) Prior Publication Data

US 2013/0195643 A1 Aug. 1, 2013

(51) Int. Cl.
*F01D 9/04* (2006.01)
*F01D 25/26* (2006.01)

(52) U.S. Cl.
USPC ..... 415/118; 415/134; 415/138; 415/209.4; 415/210.1; 29/557; 29/889.2

(58) Field of Classification Search
CPC ..... F01D 9/041; F01D 25/24; F01D 25/26; F05D 2260/941
USPC ..... 415/134–136, 138–139, 189–191, 415/208.2, 209.2–209.4, 210.1, 118; 29/557, 889.2
See application file for complete search history.

(56) References Cited

U.S. PATENT DOCUMENTS 3,043,564 A 7/1962 Small, Jr.
3,781,125 A 12/1973 Rahaim et al.
4,194,869 A * 3/1980 Corcokios ..... 415/209.4
4,244,222 A * 1/1981 Hoyer et al. ..... 415/118
4,511,306 A 4/1985 Hultgren
5,071,313 A 12/1991 Nichols
5,181,826 A 1/1993 Rock
5,185,996 A * 2/1993 Smith et al. ..... 415/118
5,593,276 A 1/1997 Proctor et al.
5,618,161 A * 4/1997 Papageorgiou et al. ..... 415/190
5,655,876 A * 8/1997 Rock et al. ..... 415/139
6,612,808 B2 9/2003 Lee et al.
6,733,237 B2 5/2004 Ingistov
7,097,422 B2 8/2006 Rice et al.

(Continued)

FOREIGN PATENT DOCUMENTS

EP 0344877 A1 12/1989
EP 1793088 A2 6/2007

OTHER PUBLICATIONS

European Search Report issued on corresponding European Patent Application No. EP 13 15 1849, Jun. 28, 2013.

*Primary Examiner* — Christopher Verdier
(74) *Attorney, Agent, or Firm* — Norton Rose Fulbright Canada LLP

(57) ABSTRACT

A turbine vane ring has radially outer and inner annular shrouds defining therebetween an annular gaspath. Circumferentially spaced-apart airfoil vanes extend radially across the gaspath between the outer and the inner shrouds. The radially outer shroud has a circumferentially continuous cylindrical wall extending axially from a leading edge to a trailing edge. A set of circumferentially distributed stress relieving slots is defined in the leading edge of the cylindrical wall at locations adjacent to the leading edge of at least some of said airfoil vanes. The stress relieving slots extend radially through the cylindrical wall from the radially inner surface to the opposed radially outer surface thereof.

17 Claims, 3 Drawing Sheets

(56) References Cited

U.S. PATENT DOCUMENTS

| | | | | |
|---|---|---|---|---|
| 7,229,245 | B2 | 6/2007 | Ellis et al. | |
| 7,293,957 | B2 | 11/2007 | Ellis et al. | |
| 7,780,398 | B2 | 8/2010 | Dervaux et al. | |
| 7,887,299 | B2 | 2/2011 | Xiao | |
| 7,958,735 | B2 | 6/2011 | Ellis et al. | |
| 2004/0062636 | A1* | 4/2004 | Mazzola et al. | 415/191 |
| 2004/0156708 | A1* | 8/2004 | Allam | 415/144 |
| 2006/0127215 | A1* | 6/2006 | Durocher et al. | 415/191 |
| 2007/0050156 | A1* | 3/2007 | Vaidyanathan | 702/45 |
| 2012/0063908 | A1* | 3/2012 | Islam et al. | 416/223 A |

* cited by examiner

STRESS RELIEVING SLOTS FOR TURBINE VANE RING

TECHNICAL FIELD

The present application relates to gas turbine engines, and more particularly to an arrangement for a turbine vane ring of a gas turbine engine.

BACKGROUND ART

Turbine vane rings form portions of a turbine gaspath, sometimes by linking turbine rotors together. Turbine vane rings are often preferred to vane segments for their simplicity. Turbine vane rings are composed of an outer and an inner ring, often referred to as shrouds, which are connected together with the airfoil vanes.

Some engine operating conditions can create hot spots in the gaspath. These hotspots will unevenly heat the airfoil vanes generating localized high stresses where the peak temperatures and the stress raisers are localized. Stress raisers may consist of an array of slots that are used to pass engine instrumentations to monitor engine gaspath temperature or the provisions of narrow slots or key hole slots or T-shape slots in the rails of the turbine vane ring. To reduce leakage, thin metal plate seals may be placed in a transverse slot to close off the stress raiser openings.

SUMMARY

In accordance with another general aspect, there is provided a turbine vane ring for a gas turbine engine having an axis, the turbine vane ring comprising a radially outer annular shroud and a radially inner annular shroud concentrically disposed about the axis and defining therebetween an annular gaspath for channelling combustion gases, a plurality of circumferentially spaced-apart airfoil vanes extending radially across the gaspath between the radially outer and the radially inner annular shrouds, each airfoil vanes extending chordwise between a leading edge and a trailing edge, said radially outer shroud having a circumferentially continuous cylindrical wall extending axially from a leading edge to a trailing edge, the cylindrical wall having a radially outer surface and an opposed radially inner surface defining a flowpath boundary of the gaspath, and a first set of circumferentially distributed stress relieving slots defined in the leading edge of the cylindrical wall at locations adjacent to the leading edge of at least some of said airfoil vanes, the stress relieving slots extending radially through the cylindrical wall from the radially inner surface to the opposed radially outer surface thereof.

According to a further aspect, there is provided a method of relieving stress in airfoil vanes of a turbine vane ring of a gas turbine engine, said method comprising: forming a plurality of equidistantly spaced stress relieving slots in a leading edge of a circumferentially continuous cylindrical wall of an outer shroud of the turbine vane ring, the turbine vane ring having a plurality of airfoil vanes disposed between an inner shroud and said outer shroud, each of said stress relieving slots extending close to a fillet between an adjacent airfoil vane and the outer shroud.

DETAILED DESCRIPTION

Figure 1:
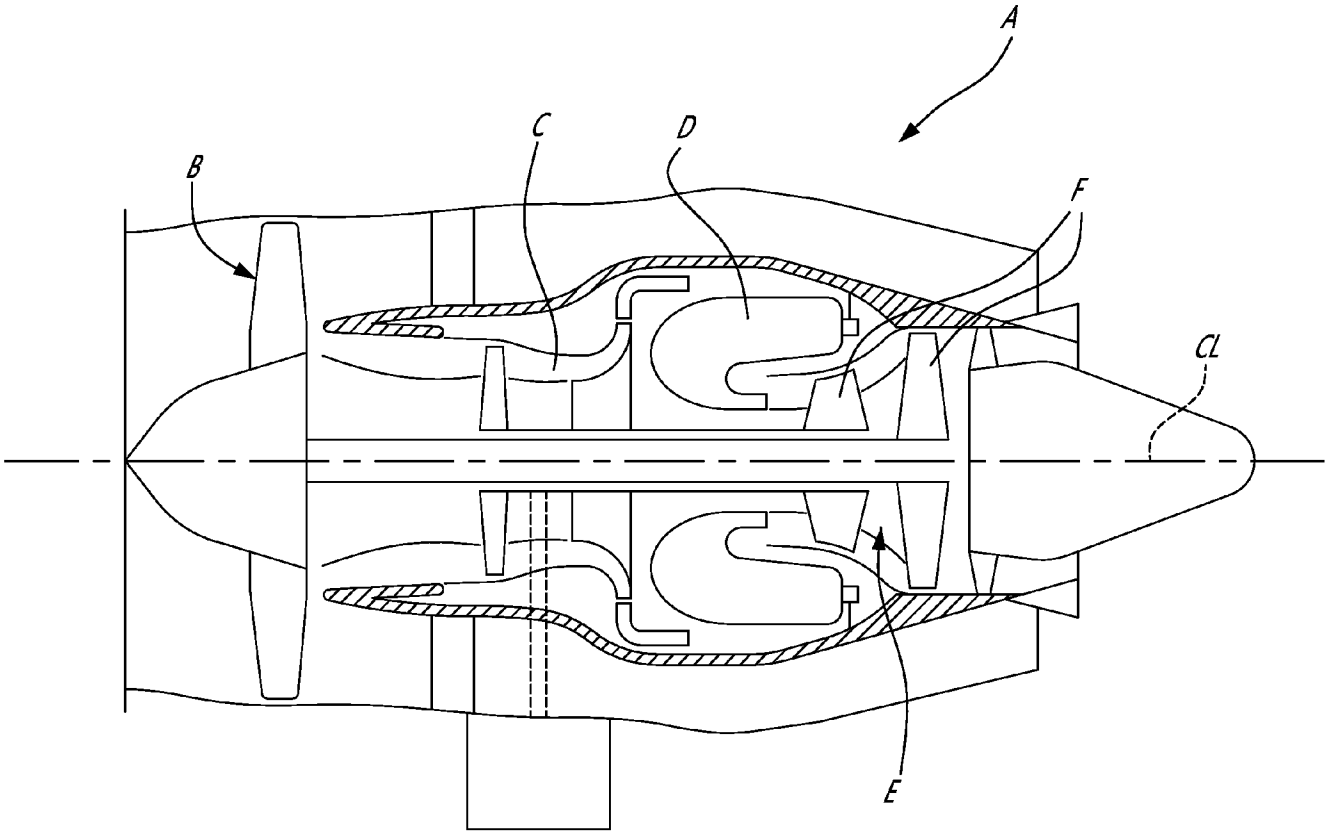
FIG. 1 is a schematic cross-sectional view of a gas turbine engine illustrating the location of the turbine vanes.

Referring now the drawings and more particularly to FIG. 1, there is shown a gas turbine engine A of a type preferably provided for use in subsonic flight, and generally comprising in serial flow communication a fan section B through which ambient air is propelled, a multi-stage compressor C for pressurizing the air, a combustor D in which the compressed air is mixed with fuel and ignited for generating an annular stream of hot combustion gases, and a turbine section E in which circumferential arrays of rotating turbine blades F are located and driven by the stream of hot combustion gases. The turbine section E also includes at least one stage of stationary turbine vanes (not shown) disposed upstream of an associated stage of rotating turbine blades F. Each stage of stationary turbine vanes can be provided as a turbine vane ring such as the one shown in FIG. 2.

Figure 2:
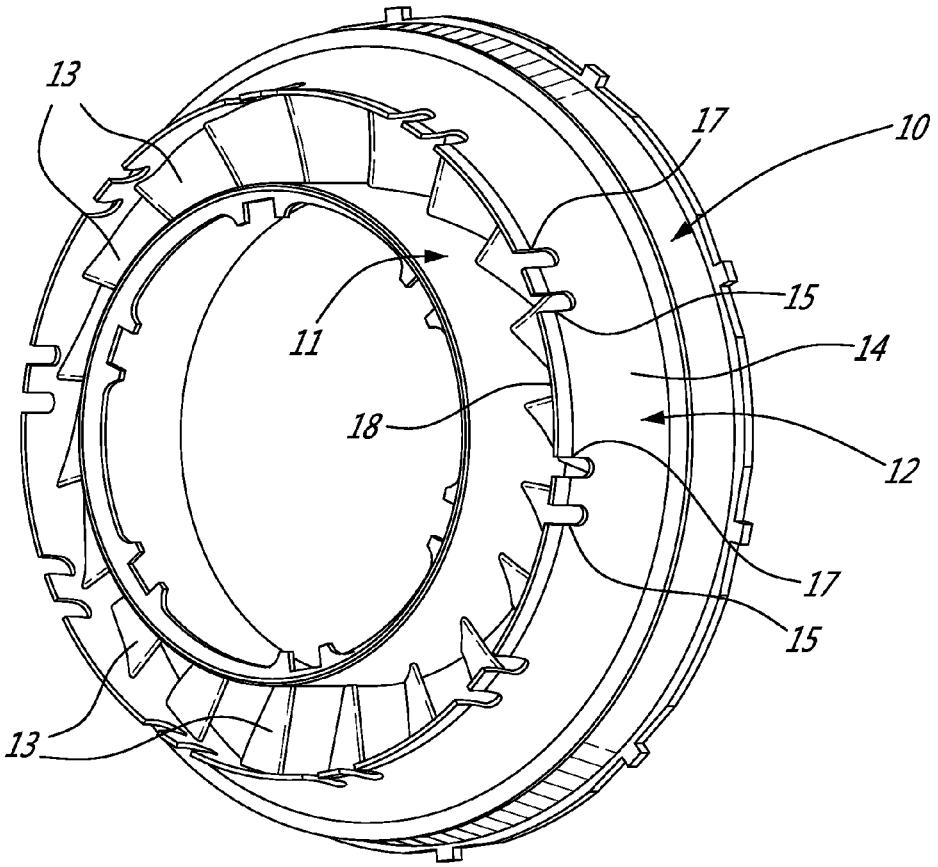
FIG. 2 is an isometric view illustrating the construction of a turbine vane ring having a plurality of stress relieving slots defined directly in the outer shroud thereof.
Figure 3:
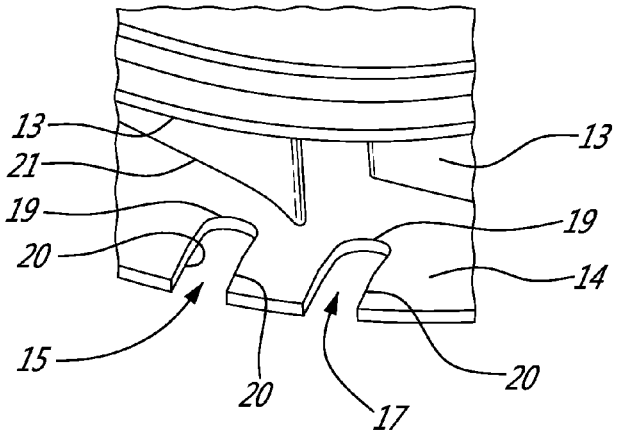
FIG. 3 is an enlarged fragmented isometric view showing the position of the stress relieving slots in relation to an airfoil vane and in relation with another slot which accommodates a temperature probe.
Figure 4:
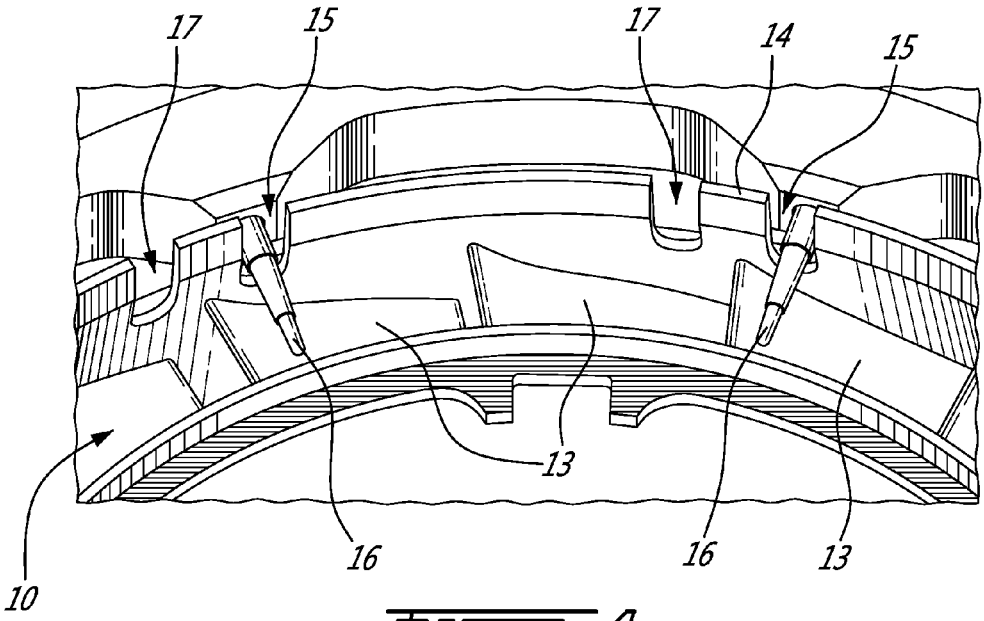
FIG. 4 is a further fragmented isometric view showing the disposition of the stress relieving slots in relation to a plurality of airfoil vanes disposed between the inner and outer shroud of a turbine vane ring.

With reference now to FIGS. 2 to 4, there will be described an example of a turbine vane ring 10. As herein shown, the turbine vane ring 10 comprises an inner annular shroud 11 and an outer annular shroud 12 interconnected by a set of circumferentially spaced-apart airfoil vanes 13 extending radially between the inner and outer shrouds 11 and 12. The inner and outer shrouds 11 and 12 define therebetween a section of the annular gaspath of the engine A. The turbine vane ring 10 is adapted to be concentrically mounted about the axis or centerline CL (see FIG. 1) of the engine A. The inner and outer shrouds 11 and 12 may be each provided in the form of a one-piece ring which is circumferentially continuous (i.e. not circumferentially segmented). The outer shroud 12 has a circumferentially continuous cylindrical wall 14 having a leading edge 18 in which there is formed a first set of slots 15, which as shown in FIG. 4, accommodate engine instrumentation, such as temperature probes 16. An instrument can be installed in at least one of these slots. The slots 15 are provided as radial-through slots (i.e. the slots extend radially completely through the thickness of the cylindrical wall from the radially inner to the opposed radially outer surfaces thereof). A plurality of stress relieving slots 17 are also formed in the leading edge 18 and equidistantly spaced about the cylindrical wall 14 of the outer shroud 12. The stress relieving slots 17 may also be provided in the form of radial-though slots. The slots 17 extend axially into the leading edge to an area close to the fillet 21 at the junction of the airfoil vanes 13 and the radially inner flow path boundary surface of the outer shroud 12 (see FIG. 3).

As more clearly shown in FIGS. 3 and 4, the stress relieving slots 17 may be provided in the form of deep wide U-shaped slots which extend in close proximity to the leading edge of at least some of the airfoil vanes 13. From FIG. 3, it can be appreciated that the slot 17 terminates close to fillet 21 at the front of at least some of the airfoil vanes 13. The stress relieving slots 17 increases the flexibility of the cylindrical wall 14 and hence the outer shroud 12 and thereby reduce stress in the existing instrumentation slots 15 and in the adjacent airfoils vanes 13 caused by hot spots in the combustion gas flowing through the airfoil vanes 13 of the gas turbine engine A. The position of the slots allows reducing the stress in the fillets between the airfoil vanes 13 and the outer shroud 12 for the fillets adjacent to the slots.

Referring again to FIG. 2, it can be seen that there are a plurality of the first set of engine instrumentation accommodating slots 15 and of the stress relieving slots 17. The stress relieving slots 17 are disposed circumferentially adjacent and in close proximity to the first set of slots 15 to form pairs of slots equidistantly spaced about the cylindrical wall 14 to provide a uniform distribution of slots about the cylindrical 14 wall for even stress relief thereabout. From FIG. 2, it can be appreciated that the stress relieving slots 17 are circumferentially staggered relative to the slots 15. For each slot 15, there may be one stress relieving slots next to it.

As more clearly illustrated in the enlarged views of FIGS. 3 and 4, each of the stress relieving slots 17 terminate in a concavely shaped end edge 19, although this end edge may have another shape such as a flat transversed end edge. The wide slots also define spaced apart parallel side edges 20. As herein shown the stress relieving slots 17 are formed identically to the instrumentation receiving slots 15 whereby a single tool is required to form both slots and this results in a saving in tooling cost.

As shown in FIG. 4, the stress relieving slots 17 are disposed at alternate ones of the airfoil vanes 13 but it is contemplated that these may be spaced about the outer shroud cylindrical wall adjacent every vane depending on the characteristics of the turbine vane ring, such as the shape of the ring, the thickness of materials, etc. Another feature achieved by the provision of these slots is that they result in a weight reduction of the turbine vane ring. It is also not necessary to seal off these slots to reduce leakage, as is the case with some prior art turbine vane ring designs wherein the slots are defined in a rail portion of the turbine vane ring.

Accordingly, the turbine vane ring as illustrated in FIGS. 2 to 4 provides a method of relieving stress in the existing instrumentation slots and in the adjacent airfoil vanes, which stress is caused by hot spots in the gaspath. The method can be summarized as comprising the steps of forming a plurality of equidistantly spaced stress relieving slots in the leading edge of the cylindrical wall of the outer shroud of a turbine vane ring which has a plurality of airfoil vanes disposed between an inner shroud and the outer shroud. The stress relieving slots relieve stress in the existing instrumentation slots and in the adjacent airfoil vanes by increasing the flexibility of the outer shroud while reducing the weight thereof.

Some of the benefits achieved by the above described turbine vane ring may comprise maintaining gaspath integrity and minimizing the impact of performances, minimizing components exposure to hot gases and the impact on their durability. A further benefit is that it results in a weight reduction of the turbine vane ring.

The above description is meant to be exemplary only, and one skilled in the art will recognize that changes may be made to the embodiment described therein without departing from the scope of the invention disclosed. It is therefore within the ambit of the present invention to cover any obvious modifications provided that these modifications fall within the scope of the appended claims.

The invention claimed is:

1. A turbine vane ring for a gas turbine engine having an axis, the turbine vane ring comprising a radially outer annular shroud and a radially inner annular shroud concentrically disposed about the axis and defining therebetween an annular gaspath for channelling combustion gases, a plurality of circumferentially spaced-apart airfoil vanes extending radially across the gaspath between the radially outer and the radially inner annular shrouds, each airfoil vane extending chordwise between a leading edge and a trailing edge, said radially outer shroud having a circumferentially continuous cylindrical wall extending axially from a leading edge to a trailing edge, the cylindrical wall having a radially outer surface and an opposed radially inner surface defining a flowpath boundary of the gaspath, and a first set of circumferentially distributed stress relieving slots defined in the leading edge of the cylindrical wall at locations adjacent to the leading edge of at least some of said airfoil vanes, the stress relieving slots extending radially through the cylindrical wall from the radially inner surface to the opposed radially outer surface thereof.

2. The turbine vane ring defined in claim 1, wherein each of the stress relieving slots extends axially into the leading edge of the cylindrical wall of the outer shroud to an area close to a fillet between an associated airfoil and the outer shroud.

3. The turbine vane ring defined in claim 1, wherein a second set of slots is defined in the leading edge of the cylindrical wall of the radially outer shroud, and wherein engine instruments extend through said second set of slots.

4. The turbine vane ring defined in claim 3, wherein the set of stress relieving slots and the second set of slots are circumferentially staggered.

5. The turbine vane ring defined in claim 4, wherein the set of stress relieving slots and the second set of slots are paired so that for each stress relieving slot there is an adjacent slot of the second set of slots.

6. The turbine ring defined in claim 3, wherein the stress relieving slots and the slots of the second set of slots have a similar configuration.

7. The turbine vane ring as claimed in claim 6, wherein said first and second set of slots are identical.

8. The turbine vane ring as claimed in claim 3, wherein said slots of said first and second set of slots are closely spaced to one another to form pairs of slots.

9. The turbine vane ring as claimed in claim 1, wherein said stress relieving slots are wide U-shaped slots extending from said leading edge of the at least some of said airfoil vanes and terminating closely spaced to said at least some of said airfoil vanes.

10. The turbine vane ring as claimed in claim 1, wherein said stress relieving slots axially terminate in a concave end edge and define opposed parallel side edges.

11. A turbine vane ring as claimed in claim 1, wherein said stress relieving slots are disposed at alternate ones of said airfoil vanes.

12. A method of relieving stress in airfoil vanes of a turbine vane ring of a gas turbine engine, said method comprising: forming a plurality of equidistantly spaced stress relieving slots in a leading edge of a circumferentially continuous cylindrical wall of an outer shroud of the turbine vane ring, the turbine vane ring having a plurality of airfoil vanes disposed between an inner shroud and said outer shroud, the stress relieving slots being defined in the leading edge of the cylindrical wall at locations adjacent to leading edges of at least some of said airfoil vanes, the stress relieving slots extending radially through the cylindrical wall from a radially inner surface to an opposed radially outer surface thereof.

13. The method of claim 12, wherein said stress relieving slots are formed as wide slots and project into said cylindrical wall to terminate closely spaced to at least some of said airfoil vanes.

14. The method of claim 12, further comprising forming a set of circumferentially spaced-part instrumentation accommodating slots in said leading edge of said cylindrical wall, said stress relieving slots being closely disposed to said instrumentation accommodating slots in a circumferential direction.

15. The method of claim 14 wherein said instrumentation accommodating slots and said stress relieving slots are identically formed using a same tool.

16. The method of claim 15, further comprising forming a plurality of equidistantly spaced instrumentation slots in the leading edge of the circumferentially continuous cylindrical wall, said instrumentation slots extending radially through the cylindrical wall from the radially inner surface to the opposed radially outer surface thereof.

17. The method of claim 16, further comprising installing an instrument in at least one of said instrumentation slots.

* * * * *